US007207510B2

(12) United States Patent
Wong

(10) Patent No.: US 7,207,510 B2
(45) Date of Patent: Apr. 24, 2007

(54) MEAT GRINDER WITH SUCTION BASE

(76) Inventor: Yan Kwong Wong, Room 1016-17, Metro Centre II, 21 Lam Hing Street, Kowloon Bay, Kowloon (HK)

( * ) Notice: Subject to any disclaimer, the term of this patent is extended or adjusted under 35 U.S.C. 154(b) by 0 days.

(21) Appl. No.: 11/398,405

(22) Filed: Apr. 4, 2006

(65) Prior Publication Data

US 2006/0243837 A1 Nov. 2, 2006

(30) Foreign Application Priority Data

Apr. 4, 2005 (CN) ..... 2005 2 0004595

(51) Int. Cl.
*B02C 17/16* (2006.01)
*A47G 1/17* (2006.01)

(52) U.S. Cl. ..... 241/82.1; 241/82.4; 248/205.3; 248/362

(58) Field of Classification Search ..... 241/82.1, 241/82.5, 82.4, 92; 248/362, 363, 205.3
See application file for complete search history.

(56) References Cited

U.S. PATENT DOCUMENTS 4,180,229 A 12/1979 Schulein
4,181,163 A 1/1980 Schulein
4,602,543 A 7/1986 Homma
4,817,481 A 4/1989 Homma
6,666,420 B1 * 12/2003 Carnevali ..... 248/205.8

FOREIGN PATENT DOCUMENTS

CN 2066769 U 12/1990
CN 2297151 Y 11/1998
CN 2357514 Y 1/2000
CN 2527348 Y 12/2002
CN 2542180 Y 4/2003

OTHER PUBLICATIONS

English-language translation of the patent's first page Search Report by SIPO.

* cited by examiner

*Primary Examiner*—Faye Francis
(74) *Attorney, Agent, or Firm*—Law Office of Sergei Orel, LLC

(57) ABSTRACT

This invention contains a suction base meat grinder consisting of a meat grinder with a suction base and manually operated grinding unit. Turning a rotating disk first, the user will firmly fix this meat grinder to the kitchen table surface, as well as lock the base to the upper grinding part. Then the user can rotate the handle to spin the screw bolt and the pedal blade, pushing meat to go through the pedal blade, and be grinded into ground meat, thus finishing the grinding process. Meanwhile, this grinder is made up by the grinding unit and the sucking base. The grinding unit and the sucking base can be separated at cleansing time, making it easier to clean.

8 Claims, 6 Drawing Sheets

MEAT GRINDER WITH SUCTION BASE

TECHNICAL FIELD

This invention is about a new meat grinder, in particular, a meat grinder with a suction base and manual operated grinding unit.

BACKGROUND TECHNOLOGY

Meat grinder is a tool used to grind large chunks of meat into ground meat. This invention achieves this goal manually by repetitively rotating the handle to drive the screw bolt and pedal blade into rotation. This forces the meat to pass the rotating pedal blade under pressure, thus smashed into meat particles of small size. The characteristic of this invention is its fixing sucking disk at the bottom. Before grinding, by turning the rotating disk, the user can fix the meat grinder on the kitchen table, and lock the base with its grinding unit. Currently, most manual grinders use the same method to grind meat, but most of them cannot mount the grinder onto the kitchen table. Thus the grinding process is not very convenient.

Besides, most modern grinders are all-in-one, i.e., the grinding unit is fixed to its base. This makes them difficult to clean.

SUMMARY OF THE INVENTION

Based on the above issues, the purpose of this invention is to provide a meat grinder with a suction base and manual operated grinding unit. Turning a rotating disk first, the user will firmly fix this meat grinder to the kitchen table surface, as well as lock the base to the upper grinding part. Then the user can rotate the handle to spin the screw bolt and the pedal blade, pushing meat to go through the pedal blade, and be grinded into ground meat, thus finishing the grinding process. Meanwhile, this grinder is made up by the grinding unit and the suction base. The grinding unit and the suction base can be separated at cleansing time, making it easier to clean. Thus it resolves the two issues mentioned above.

To achieve this goal, this invention provides a meat grinder with a suction base and manual operated grinding unit. It includes: a grinding unit on top of the abovementioned base. This grinding unit is an existing public technology, which consists of grinding body, pressing bar, handle, and screw blade unit. When operating, the rotation of the handle will drive the bolt and pedal blade to rotate, which will push the pressed meat through the pedal blade into ground meat.

One of the special features of this invention is that the suction disk can be separated from the abovementioned grinding unit. This suction base includes: an upper cover on the top of the suction base, which has a round bottom, a long arc-shaped motion-stopper opening on its side, a upper cover rubber plug sink in the center, a upper cover central opening in the center of the sink, one rubber plug holding opening on each side of the sink, and a holding bolt socket on each of the four corners. The top of the abovementioned upper cover is a reversed arc shape, which matches the shape of the abovementioned grind unit. Below the abovementioned reverse arc there is a rectangle grinding unit holding slot. There is a slightly bulging locking dock on the surface of the holding slot. The suction base also contains a rotating disk beneath the upper cover, which has a large handle and several small handles distributed evenly along the outer rim. In the inner-facing surface, there is a motion-stopper and rotating disk base locker. The rotating disk base locker has an H shape. The two inner-facing sides of abovementioned rotating disk base locker are a locker stopping surface and a locker pressing surface, respectively. The locker stopping surface and locker pressing surface are the end of a rectangle and the end of a triangle. Under the locker stopping surface and locker pressing surface, there are two rows of rotating disk inner teeth along the inner circle of the rotating disk.

The suction base also contains a base beneath the rotating disk. The bottom of the cone shaped base extends out to form a skirt. At the top of it is a raised base platform. The platform has a base central opening at the center. It also has one holding bolt opening at each of the four corners on the outside. Outside this platform, there is an embedded locker motion rail, which allows the abovementioned rotating disk base locker to slide in the embedded rail. At one end of the rail there is a rectangle motion stopper locker. At the end of this motion stopper locker there is a locker hook. Two inner teeth locking openings are located at the two lower sides of the platform. And there is a small gear axle on each side of the platform, where it is close to the bottom, and close to the central opening. Similarly, outside the holding bolt opening of the bottom part, there is one fixing screw socket on each of the four corners. There are four holding bolts that will go through the abovementioned holding bolt openings and screw into holding bolt sockets, two small gears that are placed between the small gear axle and small gear fixing pillar and there is a direction changing gear that is placed between the two small gears and under the base central opening.

The direction changing gear has teeth on the outside, and its center is hollow, which is called the direction changing gear axle opening. There are screw threads inside the axle opening, which is called the gear inner thread. There is also a support board that will be installed under the gear, which has a rectangle baseboard. There is a hole on each of the four corners of the baseboard, which is called fixing screw opening. Three pods extend up from the baseboard, to allow the abovementioned three gears to be installed. The central pod of these three pods on the support board has a hole in the center, called the support board central hole. And there is one small gear fixing pod on each side. There are four fixing screws that will go through the abovementioned fixing screw openings and screw into the fixing screw sockets.

There is also a suction disk that will be installed at the bottom of this invention. It is completely covered by the bottom of the base, and has a hole in the center. This suction disk is made from flexible materials that will change shape under force. There is also a suction disk stick that will be inserted into the suction disk center hole. It has a baseboard that is very close to a round plate. There is a suction disk stick axle extending from the center of the suction disk baseboard, through the suction disk center hole, and extends upside until it is above the upper cover central opening. There are screw threads over the suction disk stick axle. Finally, there is a suction disk stick plug that will be installed at the bottom of the suction disk stick. It is a plug that is smaller than the suction disk stick.

Meanwhile, the above mentioned suction disk is connected to the grinding unit through a suction disk locking device between them. The device includes a suction disk stick spring that will be installed on the top of suction disk stick. This spring has a shape of letter C to lock the protruding suction disk stick axle and prevent it from slipping out.

Prior to grinding, the user only needs to rotate the rotating disk. That will not only mount the meat grinder to the kitchen table, but also lock the base with the upper grinding unit. Then the user can repetitively rotate the handle to spin the screw bolt and the pedal blade, pushing meat to go through the pedal blade, and be grinded into ground meat, thus finishes the grinding process. That resolved the troubles that caused by the fact that current meat grinders cannot be mounted to kitchen tables during grinding operation. Meanwhile, this grinder consists of two assembled units: the grinding unit and the suction base. The grinding unit and the suction base can be separated at cleansing time, making it easier to clean. Thus, it resolved the two issues mentioned above.

DETAILED DESCRIPTION

Figure 1:
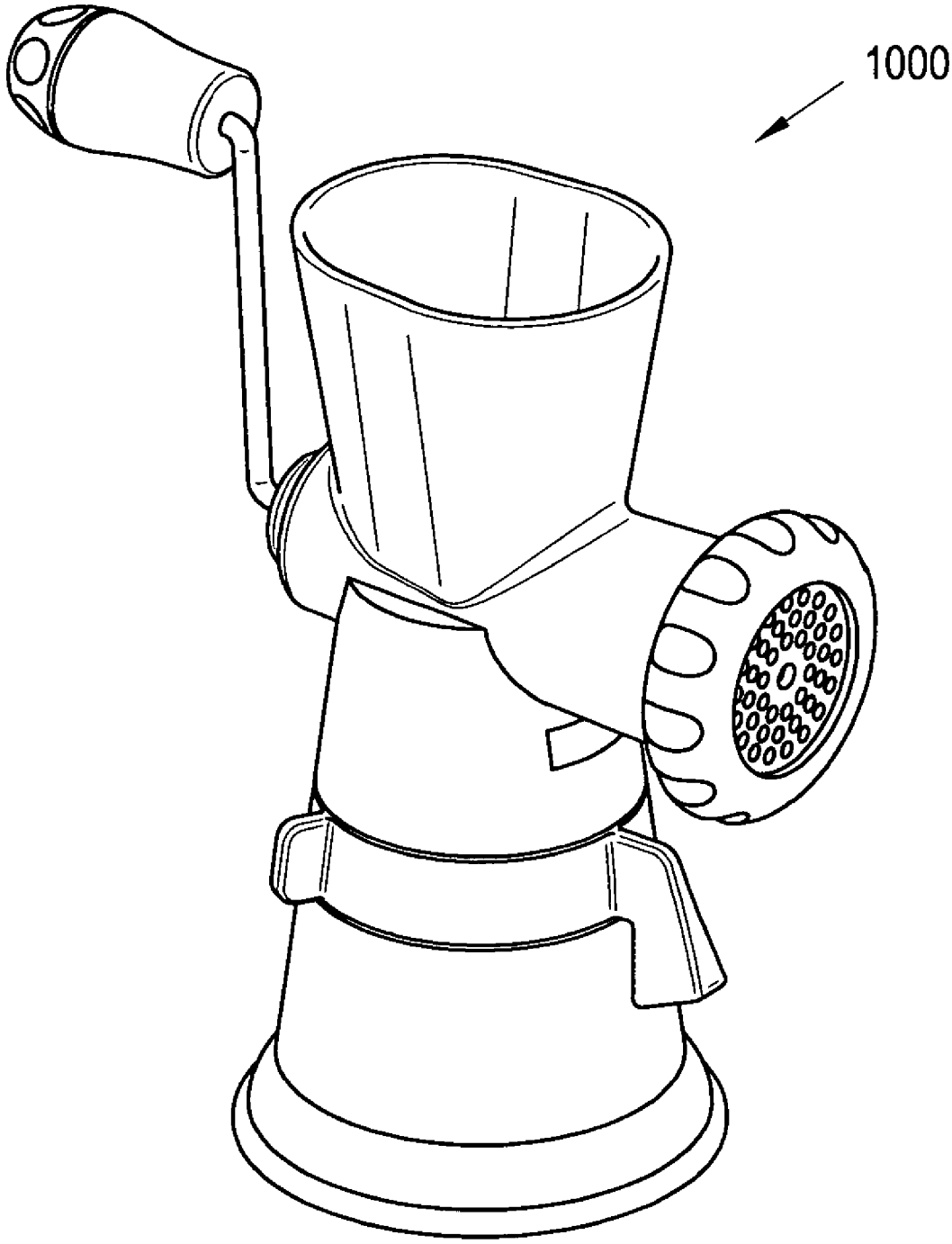
FIG. 1 is the front view of this invention: The meat grinder with a suction base.
Figure 2:
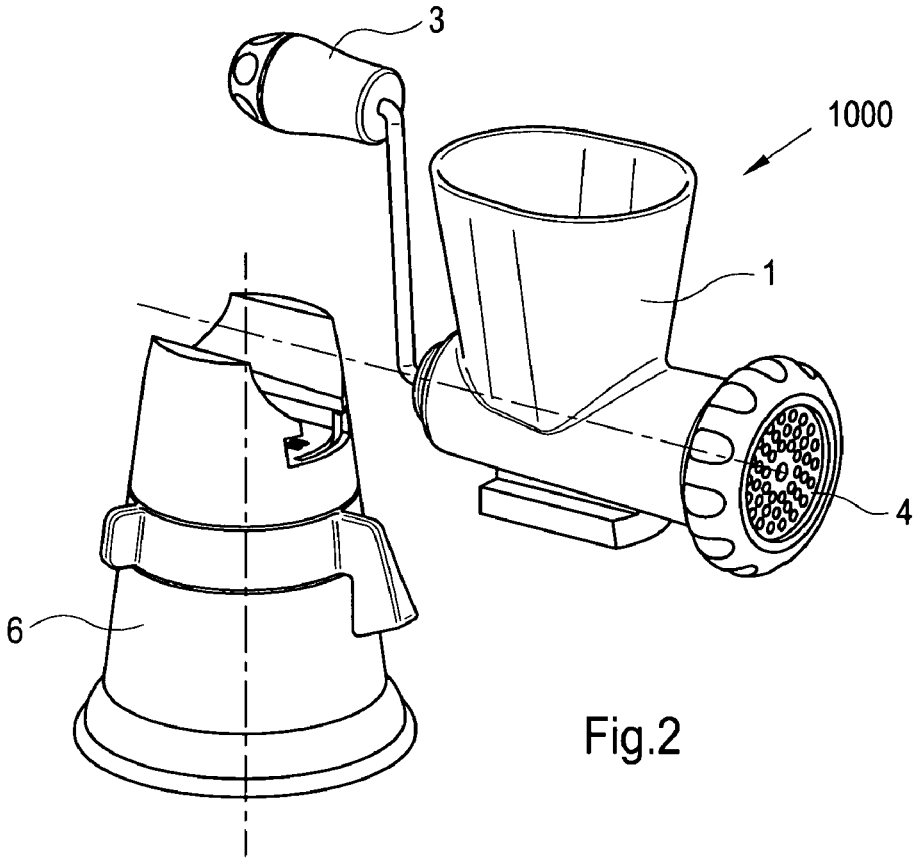
FIG. 2 is the dissembled view of the two components of this invention: The meat grinder with a suction base.
Figure 3:
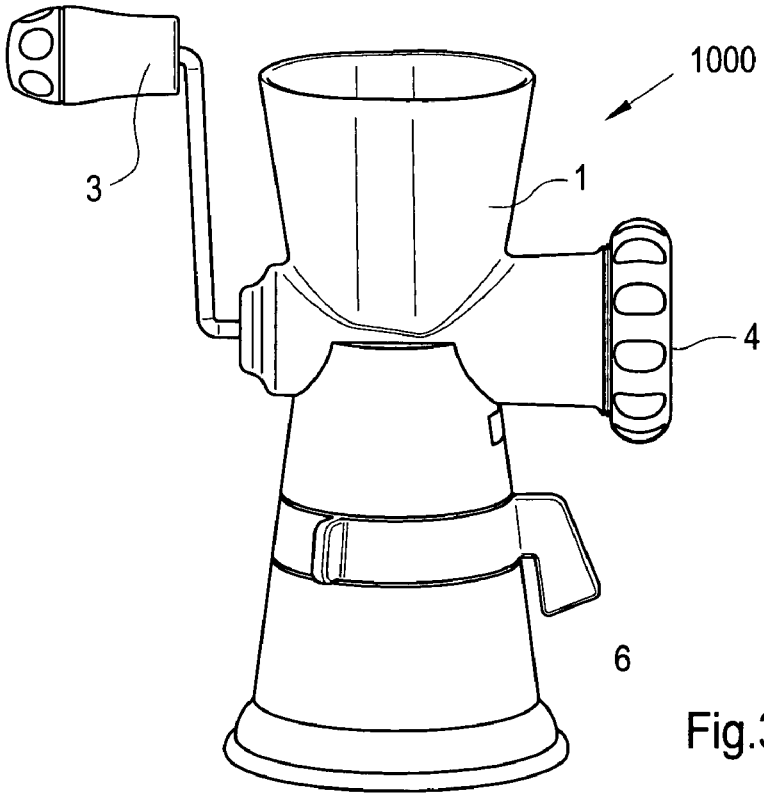
FIG. 3 is the side view of this invention: The meat grinder with a suction base.

FIG. 1 shows the front view of this invention: The meat grinder with a suction base 1000. FIG. 2 and FIG. 3 show the dissembled view and side view of this invention: The meat grinder with a suction base, respectively. It consists of: a grinding unit 1 that will be placed on the upper portion of this invention, a pressing bar 2 that will be placed into the grinding unit 1, a handle 3 that will be placed on the side of the grinding unit 1, a bolt/pedal blade unit 4 that will be placed inside the grinding unit 1, which, once connected with handle 3 inside the grinding unit 1, will achieve the goal of grinding meat, a fixing suction unit 6 that will be placed on the lower portion of this invention, and a suction disk locking unit 5 that will be placed between fixing suction unit 6 and grinding unit 1.

Figure 4:
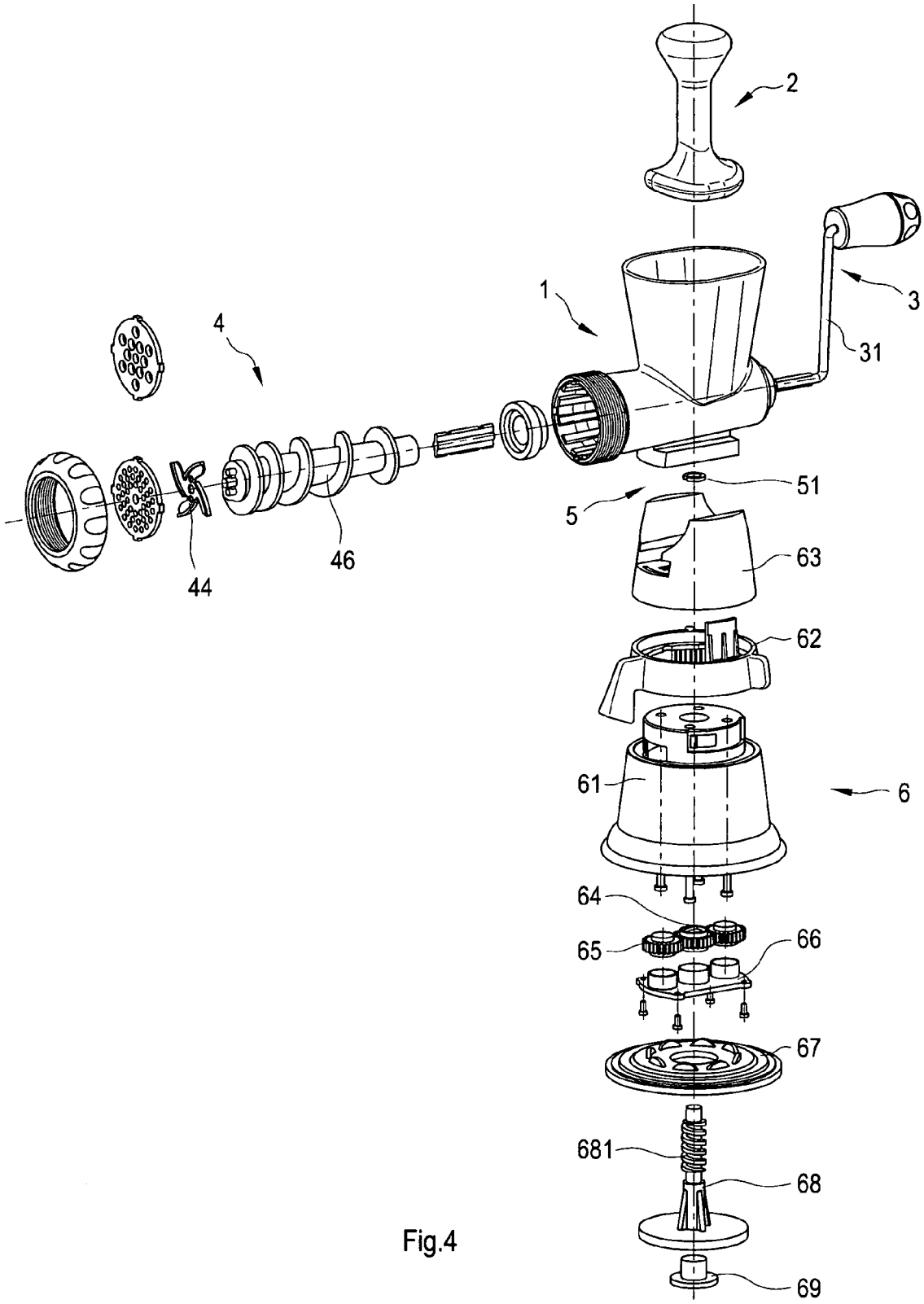
FIG. 4 is the dissembled internal view of this invention: The meat grinder with a suction base.

Referring to FIG. 4, the dissembled internal view of the meat grinder with a suction base is shown. The Figure shows the position of the abovementioned six units and their components. First of all is the grinding unit on the top of the base of this invention. This grinding unit includes the abovementioned grinding unit 1, pressing bar 2, handle 3, and bolt/pedal blade unit 4. This is an existing public technology. The operation is to use the rotation of handle 31 to drive bolt 46 and pedal blade 44 to spin. This will make the pressed meat go through the rotating pedal blade 44, thus smashed into ground meat particles of smaller size. On the other hand, there is a suction disk locking unit 5 and suction unit 6 beneath the grinding unit. This suction disk locking unit 5 is a C-shaped suction disk stick spring 51 that is installed on top of suction disk stick 68 (please refer to FIG. 7). This suction disk stick spring 51 is used to tighten suction disk stick 68 so that they will not get loose. The sucking unit 6 consists of an upper cover 63 on the top of the suction unit. This upper cover 63 has a round bottom. On one side, there is a long arc-shaped motion-stopper opening 632 (please refer to FIG. 9–FIG. 11). There is an upper cover rubber plug indentation 637 in the center of the upper cover 63, where in its center there is an upper cover central opening 633 (please refer to FIG. 9–FIG. 11), with one rubber plug holding opening 634 on each side. On each of the four corners close to the inner rim, there is a holding bolt socket 636 (please refer to FIG. 9–FIG. 11), which allows four holding bolts to go through the holding bolt opening 615 of base 61 (please refer to FIG. 12–FIG. 13) and screw in to the abovementioned socket 636 to lock upper cover 63, rotating disk 62, and base 61.

The top of the abovementioned upper cover 63 is a reversed arc shape, which matches the shape of the abovementioned grind unit 1. Below the abovementioned reverse arc there is a rectangle grinding unit holding slot 631 (please refer to FIG. 9–FIG. 11). There is a slightly bulging locking dock 635 on the surface of the holding slot 631. There is also a rotating disk 62 beneath the upper cover 63 (please refer to FIG. 9–FIG. 11), which has a large handle 622 (please refer to FIG. 14–FIG. 16) and several small handles 621 (please refer to FIG. 14–FIG. 16) distributed evenly along the outer rim. In the inner-facing surface, there is a motion-stopper 623 (please refer to FIG. 14–FIG. 16) and rotating disk base locker 625 (please refer to FIG. 14–FIG. 16). The rotating disk base locker 625 has an H shape. The two inner-facing sides of abovementioned rotating disk base locker are a locker stopping surface 626 (please refer to FIG. 14–FIG. 16) and a locker pressing surface 627 (please refer to FIG. 14–FIG. 16), respectively. They are respectively the end of a rectangle and the end of a triangle. Under the surfaces, there are two rows of rotating disk inner teeth 624 (please refer to FIG. 14–FIG. 16) along the inner circle of the rotating disk 62. The suction base also contains a cone-shaped base 61 beneath the rotating disk 62. At the top of it is a raised base platform 619 (please refer to FIG. 12–FIG. 13). The platform 619 has a base central opening 614 at the center (please refer to FIG. 12–FIG. 13). It also has one holding bolt opening 615 at each of the four corners on the outside. Outside this platform, there is an embedded locker motion rail 611 (please refer to FIG. 12–FIG. 13), which allows the abovementioned rotating disk base locker 625 to slide in the embedded rail 611. At one end of the rail 611 there is a rectangle motion stopper locker 612 (please refer to FIG. 12–FIG. 13). At the end of this motion stopper locker 612 there is a bulging locker hook 613 (please refer to FIG. 12–FIG. 13). Two inner teeth locking openings 616 are located at the two lower sides of the platform 619 (please refer to FIG. 12–FIG. 13). And there is one small gear axle 617 (please refer to FIG. 12–FIG. 13) on each side of the platform 619, which is close to the central opening 614.

Similarly, outside the holding bolt opening 615, there is one fixing screw socket 618 (please refer to FIG. 12–FIG. 13) on each of the four corners, which allows four fixing screw to pass through the fixing screw opening 664 (please refer to FIG. 8) on the base 61 to screw into the abovementioned socket 618, thus fixing the small gear 65 and direction changing gear 64 located between support board 66 and base 61. The baseboard 663 (please refer to FIG. 8) of support board 66 will support the abovementioned gears. Three pods extend up from the baseboard 663, to allow the abovementioned three gears installed. And the central pod 662 (please refer to FIG. 8) will act as the axle when the direction changing gear 64 spins. In the center of the support board central pod 662 there is a hole called support board central hole 661 (please refer to FIG. 8), which will allow sucking disk stick 68 to pass through and extend outside upper cover central opening 633. On both sides there is a small gear fixing pod 665 (please refer to FIG. 8) which acts as the axle when the abovementioned small gear 65 spins. The two small gears 65 are clenched to the central direction changing gear 64 to change direction, which means when the two small gears spin clockwise, the direction changing gear will spin counterclockwise. On the outside of the direction changing gear 64, there are outer teeth 641 (please refer to FIG. 5). The center of the gear is hollow, which is called the direction changing gear axle opening 643 (please refer to FIG. 5). There are screw threads inside the axle opening 643, which is called the gear inner thread 642 (please refer to FIG. 5). The thread will rightly clench to the axle thread 681 of the sucking disk axle 683 (please refer to FIG. 7), which goes through the axle opening 643. At the bottom of this suction disk stick 68, there is a suction disk baseboard 682 (please refer to FIG. 7) that looks like a round plate. This suction disk baseboard 682 supports a suction disk 67 that will be installed at the very bottom of this invention. This suction disk 67 is completely covered by the bottom of base 61. It has an opening in the center to allow suction disk stick axle 683 to pass through. The material that is used to make this suction disk must be very flexible. It will change the shape when under force. Finally, there is a suction disk stick plug 69 on the bottom of suction disk stick 68.

Figure 5:
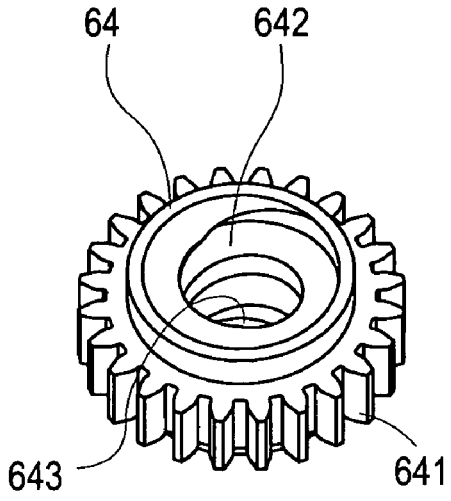
FIG. 5 is the perspective view of the direction changing gear shown in FIG. 4.
Figure 6:
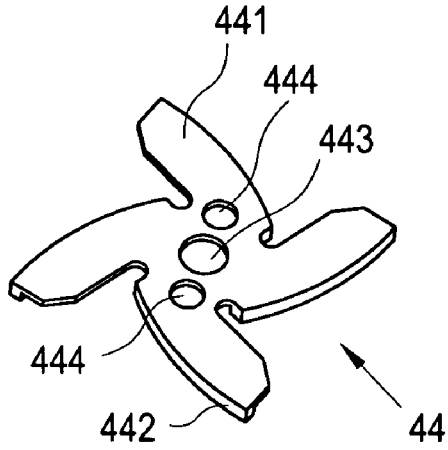
FIG. 6 is the perspective view of the pedal blade shown in FIG. 4.
Figure 7:
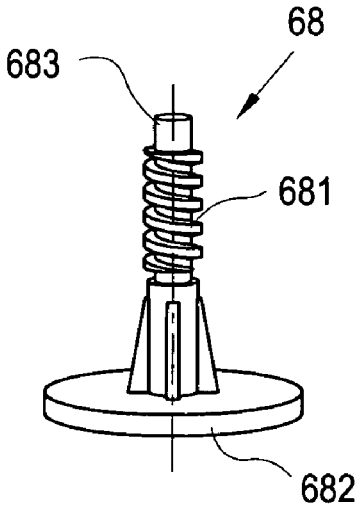
FIG. 7 is the perspective view of the suction disk stick shown in FIG. 4.
Figure 8:
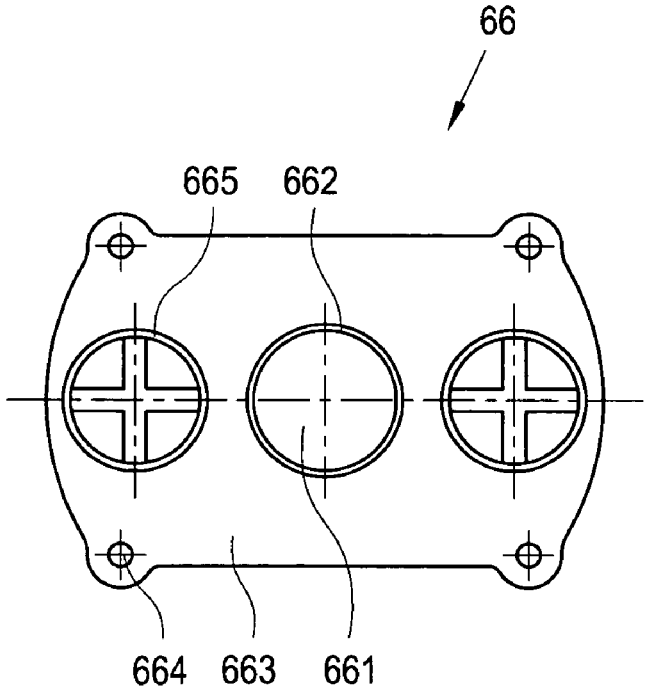
FIG. 8 is the vertical view of the support board shown in FIG. 4.
Figure 9:
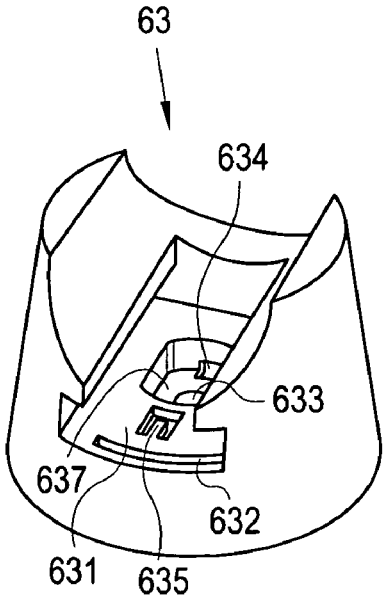
FIG. 9 is the perspective view of the upper cover shown in FIG. 4.
Figure 10:
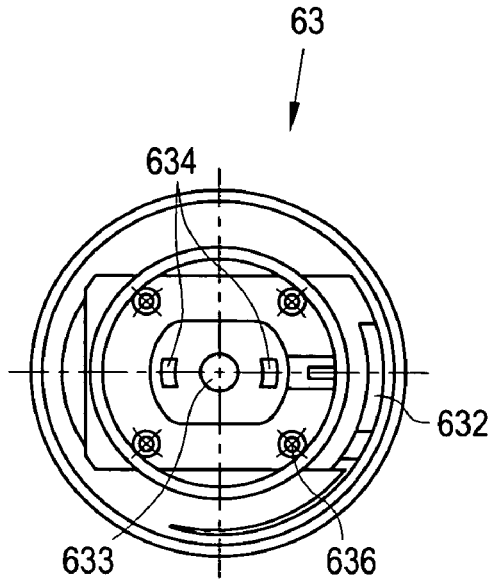
FIG. 10 is the bottom view of the upper cover shown in FIG. 9.
Figure 11:
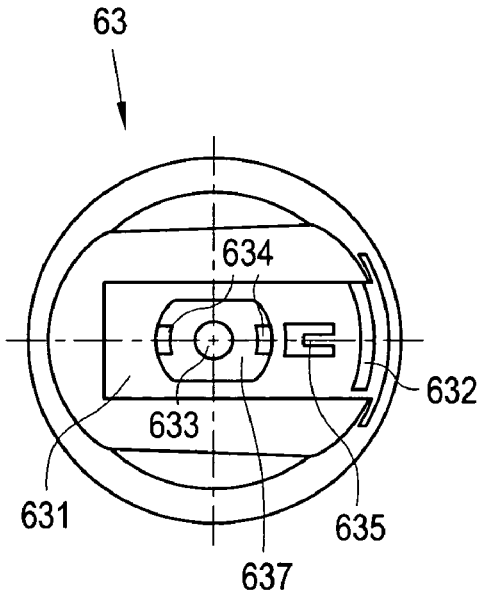
FIG. 11 is the vertical view of the upper cover shown in FIG. 9.
Figure 12:
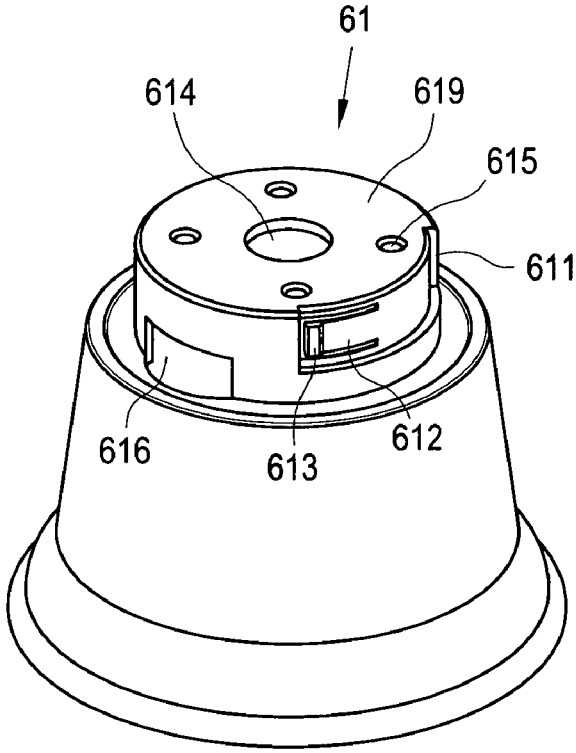
FIG. 12 is the perspective view of the base unit shown in FIG. 4.
Figure 13:
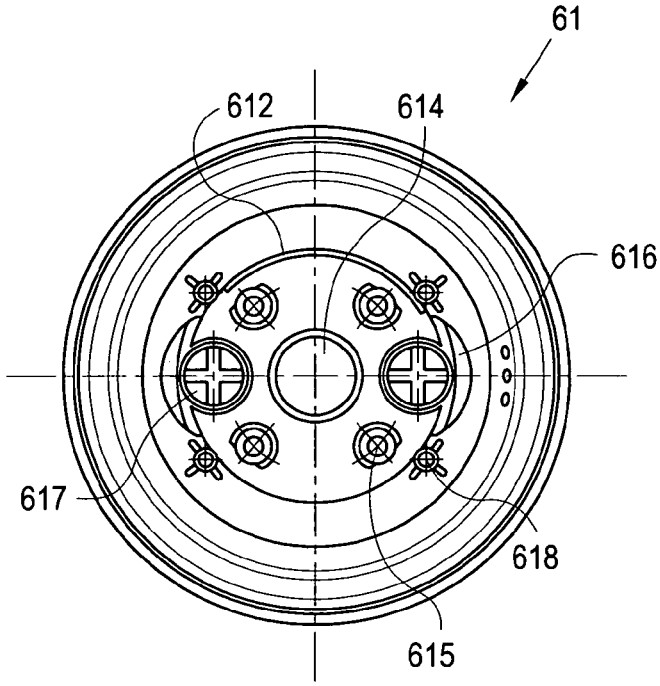
FIG. 13 is the bottom view of the base unit shown in FIG. 12.
Figure 14:
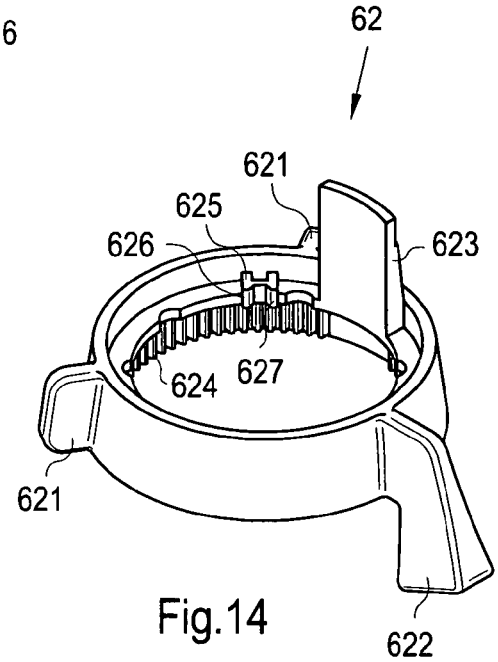
FIG. 14 is the perspective view of the rotating disk shown in FIG. 4.
Figure 15:
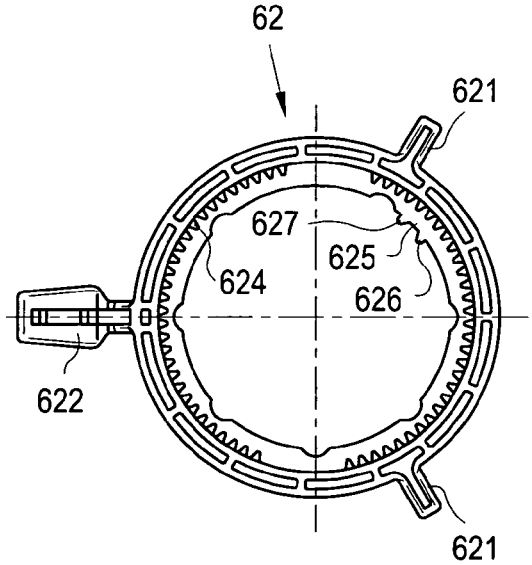
FIG. 15 is the bottom view of the rotating disk shown in FIG. 14.
Figure 16:
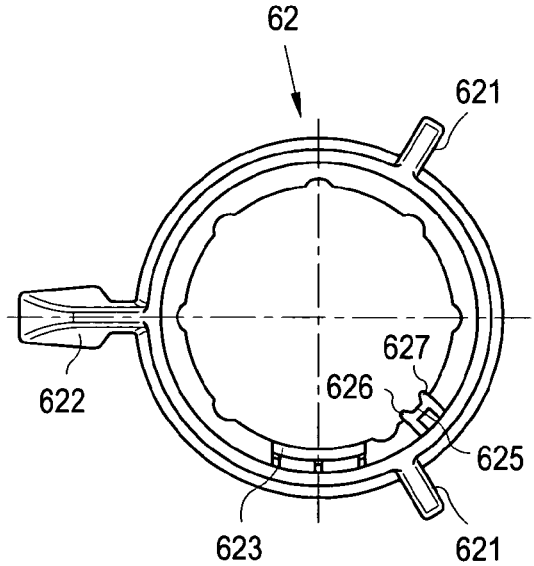
FIG. 16 is the vertical view of the rotating disk shown in FIG. 14.

Referring to FIG. 5 and FIG. 16, the views from different angles for different components of this invention are shown. FIG. 5 shows a perspective view of the direction changing gear 64. FIG. 6 shows a perspective view of the pedal blade 44. FIG. 7 shows a perspective view of the suction disk stick 68. FIG. 8 shows a vertical view of the support board 66. FIGS. 9 to 11 show the perspective view, bottom view, and vertical view of the upper cover 63. FIG. 12 and FIG. 13 show the perspective view and bottom view of the base unit 61 and FIG. 14 to FIG. 16 show the perspective view, bottom view, and vertical view of the rotating disk 62. These Figures are provided as part of the descriptions provided herein. They can also help to understand the operation of suction disk 6.

Prior to the grinding, first rotate the rotating disk 62 to mount the grinder 1000 to the kitchen table. This will also lock the base unit and the upper grinding unit. When spinning rotating disk 62, rotating disk base locker 625 will move in the locker motion rail 611, until locker stopping surface 626 of rotating disk base locker 625 touches the locker hook 613 of motion stopper locker 612. By applying a slight force, the locker stopping surface 626 with a triangle shaped end will go pass the locker hook 613 to reach the end of locker motion rail 611, thus securing the position. With the rotation of rotating disk 62, the motion-stopper 623 on it will also rotate. When rotating disk 62 arrives in the position that was described above, the motion-stopper 623 will be positioned on top of motion-stopper opening 632, thus extend out of the grinding unit holding slot 631. Then the motion-stopper 623 will be plugged into a sink at the bottom of the grinding unit 1, locking the base and the upper grinding unit firmly. With the rotation of the rotating disk 62, the rotating disk inner teeth 624 are also rotating. This will drive the small gears 65 that are located in the inner teeth locking openings 616 and clench to the rotating disk inner teeth 624 to rotate, too, which, in turn, will drive the direction changing gear 64 that is between the two small gears and clenched to them to rotate to the opposite direction.

Since the suction disk axle 683 of suction disk stick 68 is placed inside the direction changing gear axle opening 643, which is in the center of the direction changing gear 64, and the suction disk stick central axle thread 681 on the suction disk axle 683 is clenched to the direction changing gear inner thread 642 on the direction changing gear axle opening 643, the rotation of direction changing gear 64 will drive the suction disk stick 68 to move upward slightly. Since suction disk 67 is flexible, the center of the suction disk 67 will be pull up by suction disk stick 68. At the same time, the rim of the suction disk 67 still remains on the surface of kitchen table. This will create a vacuum between the kitchen table and the suction disk stick 68. This will allow the grinder 1000 to be mounted firmly on the kitchen table.

Based on the abovementioned structure we can see that, since this invention provides a new original design, the operation of this invention is more convenient. Prior to grinding, the user only needs to rotate the rotating disk 62. That will not only mount the meat grinder 1000 to the kitchen table, but also lock the base with the upper grinding unit. Then the user can repetitively rotate the handle 31 to spin the screw bolt 46 and the pedal blade 44, pushing meat to go through the pedal blade 44, and be grinded into ground meat, thus finishes the grinding process. That resolves the troubles that caused by the fact that current meat grinders cannot be mounted to kitchen tables during grinding operation. Meanwhile, this grinder consists of two assembled units: the grinding unit and the suction base. The grinding unit and the suction base can be separated at cleansing time, making it easier to clean. Thus, it resolved the two issues mentioned above.

What is claimed is:

1. A manually operated meat grinder comprising a grinding unit, which is put at the upper part of the grinder;

a pressing bar, which is placed inside the grinding unit;

a pedal blade;

a handle, which is placed on a side of the grinding unit; and, a screw blade unit, which is connected to the handle and rotates together with the handle, the screw bolt and the pedal blade, and a fixing suction unit, which is placed on top of a suction disk which includes an upper cover, which is placed on the top of a base, said cover having at least one holding bolt socket;

a rotating disk, which is placed beneath said upper cover;

the base, which is placed beneath said rotating disk and having at least one holding bolt opening, a fixing screw opening, a fixing screw socket, a central opening, and a small gear axle;

at least one holding bolt, which matches said holding bolt socket and holding bolt opening;

a small gear;

a support board, which is placed under the small gear, having a small gear fixing pillar, wherein the small gear is installed between the small gear fixing pillar and small gear axle;

a direction changing gear, which is placed under the base central opening and next to the small gear;

a fixing screw, which goes through the fixing screw opening and screws into the fixing screw socket;

the suction disk, which has a central opening and is installed at the very bottom of the base;

a suction disk stick, which is inserted into the suction disk central opening;

a suction disk stick plug, which is placed at the bottom of the suction disk stick;

and a suction disk locking unit, which is placed between the suction disk and grinding unit.

2. The meat grinder of claim 1 wherein the abovementioned suction disk locking unit is a suction disk stick spring that is installed on the top of the suction disk stick, said suction disk stick spring having a C shape to lock the protruding suction disk stick.

3. The meat grinder of claim 1 wherein the upper cover comprises, a bottom part, which is a round part with a long arc-shaped motion-stopper opening on its side;

an upper cover rubber plug sink, which sinks in the center of the upper cover; and an upper cover central opening, with one rubber plug holding opening on each side;

wherein the top of the upper cover is a reversed arc shape, which matches the shape of the bottom of the grind unit, below the abovementioned reverse arc there is a rectangle grinding unit holding slot and there is a locking dock on the surface of the holding slot.

4. The meat grinder of claim 1 wherein the rotating disk is round and includes;

one large rotation handle and several small rotating handles placed evenly along the outer side of the round shape;

a motion-stopper and rotating disk base locker, which is placed on the inner panel of the round rotating disk;

said rotating disk base locker having an H shape, the two inner-facing sides of the rotating disk base locker are a locker stopping surface and a locker pressing surface, respectively, the locker stopping surface and locker pressing surface are at the end of a rectangle and at the end of a triangle, and under the locker stopping surface and locker pressing surface, there are two rows of rotating disk inner teeth along the inner circle of the rotating disk.

5. The meat grinder of claim 1 wherein the fixing suction unit contains:

the base having a bottom part, which is a circular cone extending a skirt to the outside;

a top part, which is a platform raised from the bottom part, said platform including;

a base central opening, which is at the center of the platform;

four holding bolt openings spaced along the outside;

a locker motion rail, which has an embedded rail, which allows the rotating disk base locker to slide in the embedded rail, at one end of the rail there is a motion stopper locker and at the end of this motion stopper locker there is a locker hook; and inner teeth locking openings, which are located opposite each other at the lower sides of the platform.

6. The meat grinder of claim 1 wherein the direction changing gear further includes:

an outer gear, which is located outside of the direction changing gear;

a direction changing gear axle opening, which is located in the central hole of the direction changing gear;

gear inner screw thread, which is located in the inner circle of the direction changing gear.

7. The meat grinder of claim 1 wherein the suction disk is flexible.

8. The meat grinder of claim 1 wherein the suction disk stick includes:

a round suction disk stick bottom plate;

a central hole, which locates in the center of the stick; and a central axle of suction disk stick extending from the abovementioned suction disk stick bottom plate, up into the central hole to the top of the upper cover; and having screw threads inside the central axle.

* * * * *